US012668917B2

(12) United States Patent
Van Der Werf et al.

(10) Patent No.: US 12,668,917 B2
(45) Date of Patent: Jun. 30, 2026

(54) METHOD TO MANUFACTURE A RECYCLABLE TEXTILE PRODUCT AND THE SAID PRODUCT

(71) Applicant: Covestro (Netherlands) B.V., Geleen (NL)

(72) Inventors: Jelle Bernardus Otto Van Der Werf, Geleen (NL); Debby Leusink-Husken, Geleen (NL); Cornelis Eme Koning, Geleen (NL)

(73) Assignee: Covestro (Netherlands) B.V., Geleen (NL)

( * ) Notice: Subject to any disclaimer, the term of this patent is extended or adjusted under 35 U.S.C. 154(b) by 563 days.

(21) Appl. No.: 18/247,484

(22) PCT Filed: Sep. 28, 2021

(86) PCT No.: PCT/EP2021/076678

§ 371 (c)(1),
(2) Date: Mar. 31, 2023

(87) PCT Pub. No.: WO2022/069483

PCT Pub. Date: Apr. 7, 2022

(65) Prior Publication Data

US 2023/0416980 A1 Dec. 28, 2023

(30) Foreign Application Priority Data

Oct. 1, 2020 (EP) ..... 20199712

(51) Int. Cl.
*D06M 15/507* (2006.01)
*D06M 23/04* (2006.01)
*D06N 7/00* (2006.01)

(52) U.S. Cl.
CPC ..... *D06M 15/5075* (2013.01); *D06M 23/04* (2013.01); *D06N 7/0073* (2013.01); *D06N 2203/061* (2013.01); *D06N 2205/04* (2013.01); *D06N 2211/066* (2013.01); *D06N 2213/02* (2013.01)

(58) Field of Classification Search
CPC ..... D06M 15/5075; D06M 23/04; D06N 7/0073; D06N 2203/061; D06N 2205/04; D06N 2211/066; D06N 2213/02
See application file for complete search history.

(56) References Cited

U.S. PATENT DOCUMENTS

| | | | | |
|---|---|---|---|---|
| 4,480,085 | A | 10/1984 | Larson | |
| 5,472,763 | A | 12/1995 | Schwarz et al. | |
| 10,428,250 | B2 | 10/2019 | Tichelaar et al. | |
| 2007/0281235 | A1* | 12/2007 | Ono | G03G 9/08795 528/271 |
| 2008/0028985 | A1 | 2/2008 | Shindo et al. | |
| 2010/0260966 | A1 | 10/2010 | McGill | |
| 2014/0272262 | A1 | 9/2014 | Williams et al. | |
| 2017/0284015 | A1 | 10/2017 | Sakaguchi | |
| 2018/0119339 | A1 | 5/2018 | Mashburn et al. | |
| 2018/0127540 | A1* | 5/2018 | Yim | C08J 3/02 |
| 2020/0056072 | A1* | 2/2020 | Lu | B32B 5/18 |

FOREIGN PATENT DOCUMENTS

| | | | |
|---|---|---|---|
| CN | 1168899 | A | 12/1997 |
| CN | 1726257 | A | 1/2006 |
| CN | 110325451 | A | 10/2019 |
| EP | 0604897 | A1 | 7/1994 |
| EP | 1598476 | A1 | 11/2005 |
| EP | 3196351 | A1 | 7/2017 |
| EP | 2198263 | B1 | 8/2019 |
| GB | 2097005 | A | 10/1982 |
| JP | 8253729 | A | 10/1996 |
| WO | 2007127222 | A1 | 11/2007 |
| WO | 2012076348 | A2 | 6/2012 |
| WO | 2019244007 | A1 | 12/2019 |

* cited by examiner

*Primary Examiner* — Shane Fang
(74) *Attorney, Agent, or Firm* — The Webb Law Firm

(57) ABSTRACT

A method to manufacture a (recyclable) polyester textile product is disclosed which includes providing a first polyester sheet, stitching polyester yarns through the first sheet to form a pile on a first surface of the first sheet, the pile extending from this first surface, and to form loops of the yarns at an opposing second surface of the first sheet, applying a first quantity of a dispersion including an aqueous dispersion medium and polyester particles dispersed in the medium, to the second surface of the first sheet, thereafter removing the aqueous dispersion medium from the said quantity of the aqueous dispersion, heating the polyester particles to above a temperature at which the polyester of these particles softens, and subsequently cooling the polyester of the particles to below a temperature at which this polyester solidifies to therewith interconnect the loops and the first sheet with the solidified polyester.

16 Claims, No Drawings

METHOD TO MANUFACTURE A RECYCLABLE TEXTILE PRODUCT AND THE SAID PRODUCT

CROSS-REFERENCE TO RELATED APPLICATIONS

This application is the United States national phase of International Application No. PCT/EP2021/076678 filed Sep. 28, 2021, and claims priority to European Patent Application No. 20199712.9 filed Oct. 1, 2020, the disclosures of which are hereby incorporated by reference in their entireties.

BACKGROUND OF THE INVENTION

Field of the Invention

The invention in general pertains to a method to manufacture a recyclable textile product, in particular a floor covering, such as a carpet, a carpet tile, rug or mat, and the manufacturing thereof. In particular, the invention pertains to the manufacture of a textile product in which yarns are stitched to a sheet (commonly referred to as primary backing), to therewith form a pile on a first surface of the sheet, and to form loops of the yarns at an opposing second surface of the first sheet, and means to durably connect the yarns to the sheet at the second surface. The invention also pertains to the recyclable textile product as such.

Description of Related Art

Typically, textile products such as floor coverings are manufactured using latex, either natural or corresponding synthetic latex, applied to the back of the primary backing as an adhesive to durably bond the yarns to this primary backing by embedding the loops. Latex based floor coverings have several disadvantages. Firstly, latex coverings tend to be non-resistant to moisture. They may allow moisture to pass through which on its turn can lead to the formation of mildew and molds. This cannot only degrade the floor covering, but may also lead to environmental hazards such as poor air quality. As a consequence, when latex based floor coverings are placed in an area where moisture is a concern, for example in lobbies, they may need to be frequently replaced. Secondly, and more importantly, because latex-based floor coverings use dissimilar materials for the yarns, the primary backing and the adhesive, and usually also for the secondary backing if present, such coverings cannot be fully recycled, or at least not in a simple economically viable process. Carpet recycling technologies have been developed but are expensive and do not allow complete recycling of the materials used, mainly due to the intense embedding of the yarns and backing in the vulcanised latex. As a result, most floor coverings are simply discarded, burned or shredded. At best, shredded floor coverings are used as landfills but since vulcanised latex is hardly biodegradable (even if the yarns and primary backing would be), the shredded remains will be present for many years.

Alternatively, the conventional latex is replaced by an adhesive consisting of synthetic polymers such as polyolefines and polyurethanes. This is for example known from US 2010/0260966, which discloses a carpet tile that includes a face fabric having a top surface and a base, and a dimensionally stabilised non-woven cushion material having a stabilizing material incorporated therein. The non-woven cushion material is attached to the face fabric by using a synthetic polymer adhesive, in which adhesive the cushion material as well as the fabric are embedded for adequate bonding. Still, apart from the fact that the method is relatively complex, complete recycling of this known carpet tile is hardly possible due to the embedding of the face fabric and the cushion material in the polymer.

Another solution proposed in the art is the use of hot melt adhesives. These adhesives are popular in conventional roll carpets since they are relatively inexpensive, readily available and can be recycled more easily. Hot melt adhesives are also used in carpet tiles, as is known for example from WO 2007/127222. Still, given the fact that the bonding of the face fabric with the backing when using a hot melt adhesive needs substantial embedding of the materials in this adhesive, complete recycling remains hard. Either the face fabric, the backing or both will inevitably be contaminated with substantial amounts of the adhesive. Next to this, the tuft bind that can be obtained when using hot melt adhesives is relatively low. Therefore, such products are typically used for low end applications.

From EP 1 598 476 a method for manufacturing a textile product is known, the method comprising providing an intermediate product comprising the primary backing and yarns applied into the backing, and feeding the intermediate product along a body having a heated surface, the back surface being pressed against the said heated surface, to at least partly melt the yarns present in the intermediate product to form the textile product. Thereafter, the textile product is cooled to normal room temperature such that the molten yarn material is solidified. With this method the yarns are properly anchored in the backing without needing a secondary backing or for example latex. Therefore, the method as known from EP 1 598 476 provides substantial advantages, not only with regard to recycling but also with regard to energy and raw material savings. However, the anchoring of the yarns into the backing is not strong enough for applications were the textile product is subjected to high mechanical loads such as in the interior of cars, trains, planes, offices, shops etc. That is why preferably a thermoplastic adhesive is applied to the back of the intermediate product before it is pressed against the heated surface for anchoring the yarns.

Yet another solution is proposed in WO2012/076348. This method is an improvement over the method as known from EP 1 598 476, the improvement being that the part of the back surface that is pressed against the heated surface has a relative speed with respect to the heated surface. In the '476 patent, the heated drum rotates in conjunction with the intermediate product, thus ensuring that the part of the back surface that is pressed against the heated surface has in essence the same speed as the said heated surface. This on its turn provides that there is no, or at least hardly any, mechanical disturbance of the placement of the yarns into the backing, in particular ensuring that the yarns are not pulled out of the backing. However, as described in the '348 patent a substantially improved textile product can be obtained when there is a relative speed between the part of the back surface that is pressed against the heated surface and the heated surface itself. By enforcing a relative speed an additional mechanical force is imposed that actually spreads the molten material of the yarns. The advantage of this is that the anchoring is stronger, and thus for many applications eliminating the need for the application of an additional adhesive. This makes recycling of the product easier. Still, the obtained tuft bind is not regarded sufficient for many high end applications.

In U.S. Pat. No. 1,428,250 again an improved method is described wherein the method as disclosed in WO2012/076348 is combined with the use of a hot melt adhesive to provide additional tuft bind strength and options to apply secondary backings. Although recycling is less complicated due to the presence of the hot melt adhesive when compared to latex, the method however is rather complex and requires unconventional production apparatus when compared to traditional latex floor covering machinery, basically comprising a first station to apply the latex dispersion on the back of the tufted primary backing and a long oven to vulcanise the latex.

From US 2018/0119339 a method of manufacturing a textile product is known wherein a thermoplastic polymer coating is applied as an adhesive. The method comprises applying a quantity of an aqueous dispersion of thermoplastic polymer particles to the back of a primary backing of a tufted textile product, wherein the thermoplastic particles have an average particle size between 1 and 1,000 microns. The method comprises heating the aqueous dispersion to a temperature sufficient to remove water therefrom, and heating the thermoplastic particles on the primary backing to a temperature at or above the melting temperature of the thermoplastic particles. The method further comprises allowing the heated thermoplastic polymer particles to cool below their melting temperature whereby the loop backs are adhered to the primary backing. The advantage of this method is that conventional production apparatus as used for latex floor coverings can be used. However, recycling is still not a given, in particular when aiming at a high end textile product having a durable, water-resistant tuft bind.

OBJECT OF THE INVENTION

It is an object of the invention to devise an alternative method to manufacture a textile product that is very easy to recycle in its entirety, yet the method being relatively simple, preferably based on commonly known equipment as used for producing latex floor covering products, while the obtainable tuft bind is high and durable under regular circumstances of load and environmental conditions, making the product suitable for high end applications. It is a further object of the invention to provide a textile product that is easy to recycle while being suitable for the said high end applications.

SUMMARY OF THE INVENTION

In order to meet the object of the invention a new method to manufacture a textile product has been devised, the method comprises providing a first polyester sheet, stitching polyester yarns through the first sheet to form the pile on a first surface of the first sheet, the pile thus extending (in a perpendicular direction) from this first surface, and to form loops of the yarns at an opposing second surface of the first sheet, applying a first quantity of a dispersion comprising an aqueous dispersion medium and polyester particles dispersed in the medium, to the second surface of the first sheet, and thereafter removing the aqueous dispersion medium from the said quantity of the aqueous dispersion, heating the polyester particles to above a temperature at which the polyester of these particles softens and subsequently cooling the polyester of the particles to below a temperature at which this polyester solidifies to therewith interconnect the loops and the first sheet with the solidified polyester, wherein the polyester particles are composed of a polyester material that has a HLB (hydrophilic-lipophilic balance) value between 7.6 and 10.5.

An important feature of this method is to apply polyester materials only, viz. polyester for the primary backing (i.e. the sheet), the yarns and the adhesive. For the ease of recycling this may seem an open door, but as any skilled practitioner would understand, by imposing the severe constraint that all basic constituents have to be of polyester, while at the same time these constituents have to meet very different mechanical demands, it is difficult to devise a product that meets high end demands and at the same time is easy to manufacture using existing latex-type manufacturing technology. In particular the type of adhesive is very critical since the application process limits the type of polyesters, but notably the required tuft bind and durability require properties that are difficult to obtain without compromise to the manufacturing technology. In the art this has been widely acknowledged. The solution is often found in adding fillers, viscosity modifiers, lubricants, plasticisers, wetting agents etc. to the polyester adhesive to make sure the polyester can be applied as a common dispersion, while at the same time preventing that the adhesive has any negative influence on the pile structure, and still, the tuft bind is strong and durable. For example, recent patent application US 2018/0119339 discloses that typically 10% to 50% of fillers are used, and up to 5% of each of plasticisers, thickeners, wetting agents etc (see Table 1 of US 2018/0119339). Adding fillers and other matter however is a severe disadvantage for ease of recycling since it may require purification of the polyesters when being recycled, for example by using filters, chemical degradation methods, specific absorption using active coal or other agents etc. The inventors however have found that when using a polyester for the adhesive that has a HLB value between 7.6 and 10.5, the manufacturing using a dispersion of the polyester is possible, while at the same time being able to arrive at a high tuft bind and durable bonding, without the need of adding high amounts of fillers, tackifiers, plasticisers, wetting agents etc.

The reason why the HLB value for the polyester used as an adhesive is critical is not completely clear. The HLB system is namely particularly used to identify surfactants for oil and water emulsification, although it is also used in the art for characterizing (polyester) polymers (see e.g. Ivan Hevus et al, "Anticancer efficiency of curcumin-loaded invertible polymer micellar nanoassemblies" in *Nanostructures for Cancer Therapy,* 2017, Chapter 14, 351-382), it is used in particular for finding an agent that is able to emulsify two separate phases, and not for characterizing one of these phases as such. Still, since the HLB value is namely an expression for the relationship of the hydrophilic and hydrophobic groups of a surfactant, it may be that it is related to the property to intimately mate with the loops of the polyester yarns and the back surface of the backing. In order to arrive at a high tuft bind and good durability it is required on the one hand that the polyester (in molten/softened status) is able to flow around the loops of the yarns and wet the back surface of the backing, and on the other hand that the polyester does not get released under the influence of moist, load and temperature such as for example due to washing procedures involving water. Apparently, for an all-polyester textile product the HLB value appears to be critical for the manufacturing and durability of this product. In any case, when meeting the currently found HLB value for the polyester adhesive, the manufacturing of the product can take place using technology that corresponds to commonly used latex application and drying equipment, while arriving at a high tuft bind and durable binding without the need of adding high amounts of fillers and other materials to the polyester.

The molecular weight of the polyester appears to be non-critical for the present invention. Typically any molecular weight (Mn) between 1000 and 100.000 can be used for a dispersion in line with the invention as long as the HLB criterion is met. A preferred range is between 5000 and 10.000. The molecular weight (Mn) can be determined for example by gel-permeation chromatography. This is a polymer specific method belonging to the class of size exclusion chromatography (SEC).

To meet the second object of the invention a (recyclable) polyester textile product has been devised comprising a first polyester sheet, polyester yarns stitched through the first sheet forming the pile on a first surface of the first sheet, the pile extending from this first surface, and forming loops of the yarns at an opposing second surface of the first sheet, and a polyester adhesive provided at the second surface of the first sheet to interconnect the loops and the first sheet, wherein the polyester adhesive is composed of a polyester material that has a HLB (hydrophilic-lipophilic balance) value between 7.6 and 10.5.

It is noted that U.S. Pat. No. 5,472,763 discloses a method to manufacture a textile product, using aqueous dispersion medium and polyester particles dispersed therein. However, the HLB value of the polyester as used is not disclosed.

GB 2097005 discloses an aqueous dispersion of polyester particles. The HLB value of the polyester as used is not disclosed. However, based on the fact that a water-soluble organic compound is needed to increase the hydrophilic properties of the polyester resins and therewith be able and disperse these resins in water, indicates that the HLB value of the resins is not in a range to allow dispersion of the particles as such, in contrast with the present invention.

EP 3196351 provides a fiber sizing agent composition containing a polyester resin (A) and a reactive compound (B), wherein the polyester resin (A) is a polyester resin having an HLB of 4 to 18 and a viscosity at 30° C. of 10 to 1,000,000 Pa·s, and wherein the reactive compound (B) is at least one reactive compound selected from the group consisting of blocked isocyanates, tertiary amines, tertiary amine salts, quaternary ammonium salts, quaternary phosphonium salts, and phosphine compounds, and the weight ratio of the polyester resin (A) to the reactive compound (B) [(A)/(B)] in the fiber sizing agent composition is 99.9/0.1 to 10/90.

DATABASE WPI, Week 199649, Thomson Scientific, London, GB; AN 1996-493568 XP002802296, & JP HOS 253729 A (TOYOBO KK) 1 Oct. 1996 (1996-10-01) discloses an aqueous polyester dispersion wherein the size of the polyester particles is below 1000 nm. HLB values are not disclosed EP 0604897 discloses a thermoplastic tufted carpet made of a primary backing, tufts tufted into the primary backing, a secondary backing and a polyester hot melt adhesive disposed between the primary and secondary backing. Such a carpet can be recycled through processes known to recycle polyester including glycolysis or methanolysis.

US 2014/272262 discloses a polyester floor covering article comprising 100% polyester solution dyed face yar, a polyester primary backing layer, a polyester adhesive layer and a 100% polyester secondary backing layer in the weight range from 200 gsm to 1000 gsm.

Definitions

A textile product is a product that comprises textile (i.e. material made mainly of natural or artificial fibres, often referred to as thread or yarn), optionally with other components such as backing layers, carrier layers and/or adhesives. Laminated textile products typically comprise an upper layer of pile attached to a backing (where the raised pile fibres are also denoted as the "nap" of the product), but may also be flat weave. Such products can be of various different constructions such as woven, needle felt, knotted, tufted and/or embroidered, though tufted products are the most common type. The pile may be cut (as in a plush carpet) or form loops (as in a Berber carpet).

A polyester is a polymer in which the monomer units are linked together by an ester group. They are typically formed by polymerizing a polyhydric alcohol with a polybasic acid, and used mainly in the manufacture of resins, plastics, and textile fibers. It is well known that polyesters may be prepared by a condensation polymerisation process in which monomers providing the "acid component" (including ester-forming derivatives thereof) are reacted with monomers providing a "hydroxyl component". It is to be understood that the polyester polymers as described herein may optionally comprise autoxidisable units in the main chain or in side chains and such polyesters are known as autoxidisable polyesters. If desired the polyesters may also comprise other linking groups such as for example a proportion of carbonylamino linking groups —C(=O)—NH— (i.e. amide linking group) or —C(=O)—N—$R^2$— (tertiary amide linking group) by including an appropriate amino functional reactant as part of the hydroxyl component or alternatively all of the hydroxyl component may comprise amino functional reactants, thus resulting in a polyester amide resin, or any other copolyester as commonly known in the art.

There are many examples of dicarboxylic acids (or their ester forming derivatives such as anhydrides, acid chlorides, or lower (i.e. $C_{1-6}$) alkyl esters) which can be used in polyester synthesis for the provision of the monomers providing an acid component. Examples of suitable acids and derivatives thereof that may be used to obtain a polyester comprise adipic acid, succinic acid, sebacic acid, 1,4-cyclohexanedicarboxylic acid, 1,3-cyclohexanedicarboxylic acid, 1,2-cyclohexanedicarboxylic acid, isophthalic acid, (tere) phthalic acid 2,6-naphthalenedicarboxylic acid, 2,5-furandicarboxylic acid and/or metal salts thereof any suitable mixtures thereof, combinations thereof and/or any suitable derivatives thereof (such as esters, e.g. di($C_1$ alkyl) esters, metal salts and/or anhydrides).

Similarly, there are many examples of diols which may be used in (optionally autoxidisable) polyester resin synthesis for the provision of the monomers providing a hydroxyl component. Such diols may be of the type having only carbon atoms in their main chain. Suitable diols are for example 1,4-butanediol, 2,3-butanediol, 1,6-hexanediol, 2,2-dimethyl-1,3-propanediol (neopentyl glycol), the 1,2-, 1,3- and 1,4-cyclohexanediols and the corresponding cyclohexane dimethanols, diethylene glycol (preferably less than 5, 4, 3, 2, 1 such as for example 0 mol % diethyleneglycol), dipropylene glycol, and diols such as alkoxylated bisphenol A products, e.g. ethoxylated or propoxylated bisphenol A. The most widely type of polyester used is polyethylene terephthalate, commonly abbreviated to PET, made from terephthalic acid and monoethyleneglycol.

For the introduction of amide functionalities into the polyester, amino functional reactants may be used, such as 1,2-diaminoethane, 1,6-diaminohexane or 2-amino ethanol.

A sulfopolyester is a polyester containing ionic sulfonate ($SO_3^-$) groups, for example synthesised using a sulfomonomer such as 5-sodiosulfoisophthalic acid (5-SSIPA or SIP)

or dimethyl 5-sodiosulfoisophthalate, as one of the diacids or dialkylesters in the polyester compositions.

A loop of a yarn is a length of this yarn that may be curved away from the basic part of the yarn (not excluding that the loop is longer than the main part itself). For a textile product, the basic part of the yarn is the part that forms the upper, visible part of the product. For example, for a carpet this is the part of the yarns that forms the pile. For clothing, this is the part of the yarn that forms part of the outer surface of the clothing. The loop is the part that extends from the back surface of the product.

A sheet is a substantially two dimensional mass or material, i.e. broad and thin, typically, but not necessarily, rectangular in form, and inherently has two opposite surfaces.

A dispersion is a system containing particles dispersed in a liquid medium.

Stitching is a method of mechanically making a yarn part of an object by stitches or as if with stitches, such as by tufting, knitting, sewing, weaving etc.

A polyester material is a material of which the continuous phase, i.e. the basic constituting phase, that is made out of polyester for at least 90% (w/w), preferably 91, 92, 93, 94, 95, 96, 97, 98, 99 up to 100%. This does not exclude that the material contains for example fillers or other discontinuous material for up to 50% or even more.

A polyester product (item) is a product (item) of which the constituting polymer material is made out of polyester for at least 90% (w/w), preferably 91, 92, 93, 94, 95, 96, 97, 98, 99 up to 100%.

An amorphous polymer is a polymer which has a crystallinity less than 2% w/w (i.e. less than 2% of the mass of the polymer is present in the form of crystallised polymer, showing itself as a first order transition when melted), preferably less than 1%, or even below 0.5%.

Aqueous means freely miscible with water at room temperature. Preferably it means that the liquid content consists at least for 90% out of water, such as for example 91, 92, 93, 94, 95, 96, 97, 98, 99 or even 100%. Even more preferably, aqueous rules out the presence of water soluble organic compounds (also known as organic solvents), such as aliphatic and alicyclic alcohols, ethers, esters and ketones.

To soften a polymer means to heat a polymer such that it becomes at least tacky and malleable. The polymer may also become fluid if heated above its melting temperature.

A foam is a material formed by trapping pockets of gas in a liquid. Typically the gas is present in bubbles of different sizes (i.e., the material is polydisperse), separated by liquid regions that form films.

A layer is a thickness of material, laid on or spread over a surface. A layer may be inhomogeneous with respect to thickness and may be discontinuous in the sense that it may have holes in it.

A hot melt adhesive is a thermoplastic adhesive that is designed to be melted, i.e. heated to transform from a solid state into a liquid state to adhere materials after solidification. Hot melt adhesives are typically non-reactive, crystalline and comprise low or no amount of solvents so curing and drying are typically not necessary in order to provide adequate adhesion.

A static contact angle (also referred to as sessile drop contact angle) is the contact angle measured when a droplet is sitting on a flat surface and the three-phase boundary between the droplet, surface and surrounding air is not moving.

A recyclable product is a product that can be recycled, i.e. processed such that it can be brought back in a previous stage in a cyclic process.

DESCRIPTION OF THE INVENTION

In a further embodiment of the method according to the invention the polyester particles are composed of a polyester material that has a HLB value between 7.9 and 10.0. It was found that the higher bottom value for the HLB corresponds to a method of manufacturing that is easier, due to less stringent conditions needed to create the dispersion. For a HLB value below 8.0 it appears to be generally needed to melt the polyester to create a dispersion of particles in the dispersion medium, even if the starting material is a fine powder, or to use a solvent (such as MEK) whereas above 8.0 this is not generally needed. Also, the stability of the dispersion is improved, requiring less or no mixing to maintain the dispersion in a production environment. The lower top value for the HLB was found to be advantageous for an improved durability, in particular in a regular inner room environment where the temperature and moist level can be relatively high. The above effects are further improved when meeting an HLB value between 8.0 and 9.3.

In again a further embodiment, it was found that it is advantageous when the polyester particles are composed of a polyester material that has a static contact angle with water above 75° (such as 75, 76, 77, 78, 79, 80, 81, 82, 83° etc.), in particular above 80°, such as for example 81, 82, 83, 84, 85° etc. A higher contact angle is in particular related to a better resistance against a deterioration in tuft bind under the influence of moist, temperature and load. Although a contact angle of 120° can be obtained for some polymers such as fluorine rich olefins, the practical obtainable maximum for a polyester will probably lie around 85-90°.

In yet a further embodiment the polyester particles have a number average particle size below 1000 nm. In the art particles having a size above 1000 nm are preferentially applied. This is because it is believed to be needed to apply a sufficient amount of adhesive with a restricted amount of dispersion. This on its turn is needed to prevent that the product is completely soaked with dispersion making the drying process more cumbersome. However, it was found that below the limit of 1000 nm the manufacturing process can be further simplified since the dispersion is inherently more stable and thus, requires less mixing to be maintained at an adequate dispersion quality, while still being able to apply a sufficient amount of polyester to induce sufficient bonding. Apparently, when meeting the HLB values of the invention, less adhesive is needed to obtain a good and durable tuft bind in an all polyester product. Preferably, the polyester particles have a number average particle size between 10 and 500 nm, more preferably between 50 and 400 nm. This way, a very stable dispersion can be easily provided while at the same time a sufficient amount of adhesive can be applied.

In again another embodiment the aqueous dispersion medium contains between 90 and 100% water, for example 91, 92, 93, 94, 95, 96, 97, 98, or 99% (w/w). Water is environmentally friendly, found to be suitable when attaining to the HLB values of the current invention, and easy to re-use.

In an embodiment the dispersion is applied as a foam to the second surface of the first sheet. It was found that for some polyesters a foam is able to even improve the process and obtained product, although this seems counterintuitive, realising that the polyester adhesive needs to applied locally as a binder in between the loops and backing.

It was found that a sulfopolyester is particularly suitable for application as polyester for the polyester particles in the dispersion. This is a commonly known polyester, but not commonly known to be used as an adhesive. Surprisingly however, when attaining the HLB values according to the invention, such polyesters appear to be highly suitable in the current process. Preferably, the sulfopolyester comprises of 1-20 mol % of at least one dicarboxylic acid sulfo-monomer (such as sodiosulfo isophthalic acid, abbreviated to SSIPA), for example 2, 3, 4, 5, 6, 7, 8, 9, 10, 11, 12, 13, 14, 15, 16, 17, 18 or 19 mol % of a dicarboxylic acid sulfo-monomer.

In again another embodiment the polyester particles are composed of an amorphous polyester. In the art (semi-) crystalline polyesters are preferentially used since these are easy to melt and solidify at predetermined temperatures. However, these polyesters are typically more brittle and thus require larger amounts to obtain a durable tuft bind. Amorphous polyester is more compliant of nature (in particular above its Tg) which is advantageous for the durability of the tuft bind, even when applying less adhesive. Preferably the amorphous polyester has a glass transition temperature above 20° C. Although the Tg may be below room temperature (this seems to be a disadvantage, given the fact that the polymer is then tacky at room temperature, but since the adhesive is applied to the back surface of the backing, and thus directed away from the pile, this has no negative effect during practical use), it is preferred that it is above room temperature. This was found to be advantageous in the production process, the adhesive being non-tacky at process temperature. More preferably the amorphous polyester has a glass transition temperature between 20° C. and 50° C., such as for example 21, 22, 23, 24, 25, 26, 27, 28, 29, 30, 31, 32, 33, 34, 35, 36, 37, 38, 39, 40, 41, 42, 43, 44, 45, 46, 47, 48 and 49° C.

In an embodiment the steps of removing the aqueous dispersion medium from the said quantity of the aqueous dispersion, and heating the polyester particles to above a temperature at which the polyesters softens, take place concurrently by heating the first sheet in an oven. This may for example be a common type of oven as used for manufacturing latex carpet.

In yet another embodiment the first quantity of a dispersion is applied such that the amount of polyester particles is between 50 and 250 g/m$^2$ (such as 60, 70, 80, 90, 100, 110, 120, 130, 140, 150, 160, 170, 180, 190, 200, 210, 220, 230, 240 g/m$^2$), preferably between 80 and 150 g/m$^2$. It was found that even at this low levels of polymer adhesive a high and durable tuft bind can be obtained in the method of the present invention.

In another embodiment of the method according to the invention a second sheet is adhered to the second surface of the first sheet. Such a second sheet is also referred to as a secondary backing.

In an embodiment the second sheet is applied to the second surface of the first sheet after heating the polyester particles to above a temperature at which the polyesters softens, either before the subsequent cooling of the polyester, or by reheating the polyester particles subsequent to the said cooling.

Alternatively, after the cooling of the polyester, a second quantity of the dispersion is applied to the second surface of the first sheet, whereafter the aqueous dispersion medium is removed from the said second quantity of the aqueous dispersion, heating the polyester particles to above a temperature at which the polyester of the particles softens, applying the second sheet, and subsequently cooling the polyester of the particles to below a temperature at which this polyester solidifies to therewith connect the second sheet.

As yet another alternative, after the cooling of the polyester, a layer of hot melt adhesive is applied to the second surface of the first sheet, whereafter the second sheet is applied to therewith connect the second sheet.

All of the above further embodiments also relate to the textile product of the invention as such.

The invention will now be further elaborated upon using the following non limiting examples.

EXAMPLES

Example 1 is an example describing how to determine the HLB value of a polymer.

Example 2 describes how to determine the static contact angle.

Example 3 provides various tests for determining the quality of a textile product.

Example 4 provides various analytical methods.

Example 5 provides various examples of making dispersions of polyester particles.

Example 6 describes an example of a method to apply an aqueous dispersion of polymer particles to produce a textile product.

Example 7 describes several carpet examples as used in the examples 8 through 18.

Examples 8 through 18 are used to show the manufacturing and analysis of various textile products made in line with the present invention.

Example 1

The HLB value of any compound in the sense of this invention can be determined with the method as published by J. T. Davies in 1957, in a document titled "A quantitative kinetic theory of emulsion type I. Physical chemistry of the emulsifying agent" in *Gas/Liquid and Liquid/Liquid Interfaces. Proceedings of 2nd International Congress Surface Activity*, Butterworths, London 1957. This document provides the HLB group numbers which can be used for calculating the HLB value of polyester. These and other HLB group numbers can be found in more recent documents such as Chapter 11 of the *Handbook of Applied Surface and Colloid Chemistry*, edited by Krister Holmberg, 2001 John Wiley & Sons, Ltd, titled *Surface Chemistry in the Petroleum Industry* by James R. Kanicky et al, and in *Calculation of hydrophile-lipophile balance for polyethoxylated surfactants by group contribution method*, by Xiaowen Guo et al, Journal of Colloid and Interface Science 298 (2006) 441-450, although the latter provides a very low number (11) for the —$SO_3Na$ group which is obviously wrong. For the present invention, this number is set to be 37.4, viz. the value for —$SO_4Na$ (38.7) minus the value for —O— (1.3).

This way, the HLB value for multiple experimental polyesters A through N was calculated (see below). The results are presented in Table 1. The ratio between the monomers used varies in each case, as well as the origin of these monomers. This leads to differences in HLB value and other properties even when the type of polymer is the same. The reference material is a pure PET, having a HLB value of 7.5. This polymer cannot be used in the current manufacturing method, since without using fillers and emulsifiers it cannot be dispersed in water. The other experimental polyesters that fullfill the HLB requirements of the current invention can be used in the current method in complete absence of any fillers, emulsifiers, viscosity modifiers etc.

Compositions and properties of experimental polyesters

| Composition (g) | A | | | | E | | |
|---|---|---|---|---|---|---|---|
| Maleic anhydride | — | 8.0 | — | — | — | 8.1 | — |
| Sebacic acid | — | 8.4 | — | 10.1 | — | 9.8 | — |
| Adipic acid | 14.9 | — | — | — | 5.7 | — | 32.6 |
| IPA | — | 12.7 | 61.6 | 11.0 | — | 14.9 | — |
| TPA | 46.3 | 37.9 | — | 46.0 | 38.7 | 44.3 | 29.6 |
| SSIPA | 5.2 | — | 7.0 | 6.0 | 4.6 | — | 6.0 |
| Sorbic acid | — | 3.8 | — | — | — | 3.8 | — |
| DEG | — | — | 16.3 | — | — | — | — |
| TMP | — | 0.5 | — | 0.6 | — | 0.5 | 0.4 |
| CHDM | — | 6.1 | 11.6 | 7.4 | — | — | — |
| 1,6-HD | 50.6 | — | — | — | 35.5 | — | — |
| NPG | — | — | 22.4 | — | — | — | 25.2 |
| EG | — | — | — | — | — | 18.0 | 23.7 |
| MP-diol | — | 36.6 | — | 35.9 | — | 18.3 | — |
| recycled PET | — | — | — | — | 22.2 | — | — |
| Zinc acetate | — | — | 0.056 | — | — | — | — |
| TBT | — | — | 0.010 | — | — | — | — |
| DBTO | — | — | — | — | — | — | 0.014 |
| MBTO | 0.050 | 0.100 | — | 0.050 | 0.084 | 0.100 | — |
| Sodium acetate | 0.013 | — | 0.007 | 0.013 | 0.012 | — | 0.016 |
| LiOH | 0.013 | — | 0.007 | 0.013 | 0.012 | — | 0.016 |
| Total (gram) | 117.0 | 114.0 | 118.9 | 117.1 | 106.7 | 117.6 | 117.4 |
| destillate (gram) | 14.4 | 12.5 | 14.3 | 14.9 | 5.2 | 14.5 | 15.2 |
| Losses (gram) | 2.6 | 1.6 | 4.6 | 2.1 | 1.5 | 3.1 | 2.2 |
| Yield (gram) | 100.0 | 100.0 | 100.0 | 100.0 | 100.0 | 100.0 | 100.0 |
| Composition (g) | | | | | | | |
| Maleic anhydride | — | — | — | — | — | — | — |
| Sebacic acid | 5.0 | 5.0 | 6.6 | — | — | 6.6 | 6.3 |
| Adipic acid | — | — | 5.6 | — | — | 5.5 | 5.2 |
| IPA | 35.2 | 35.2 | 25.4 | 49.7 | 61.5 | 25.2 | 24.0 |
| TPA | 35.2 | — | — | — | — | — | — |
| SSIPA | 5.0 | 5.0 | 6.1 | 17.6 | 11.0 | 9.0 | 13.0 |
| Sorbic acid | — | — | — | — | — | — | — |
| DEG | — | — | — | 29.7 | 39.1 | — | — |
| TMP | — | — | — | — | — | — | — |
| CHDM | — | — | — | 23.1 | 11.9 | — | — |
| 1,6-HD | — | — | — | — | — | — | — |
| NPG | — | — | 9.4 | — | — | 9.5 | 9.0 |
| EG | 15.2 | 3.2 | 7.8 | — | — | 5.5 | 8.5 |
| MP-diol | 22.9 | 22.9 | 11.0 | — | — | 10.9 | 10.3 |
| recycled PET | — | 40.7 | 39.6 | — | — | 39.2 | 37.3 |
| Zinc acetate | — | — | — | — | — | — | — |
| TBT | — | — | — | — | — | — | — |
| DBTO | — | — | — | — | — | — | — |
| MBTO | 0.050 | 0.050 | 0.050 | 0.050 | 0.084 | 0.050 | 0.047 |
| Sodium acetate | 0.013 | 0.013 | — | 0.015 | 0.084 | — | — |
| LiOH | 0.013 | 0.013 | 0.012 | — | — | 0.013 | 0.012 |
| Total (gram) | 118.5 | 111.9 | 111.5 | 120.2 | 123.7 | 111.4 | 113.7 |
| destillate (gram) | 16.8 | 9.2 | 8.9 | 13.1 | 15.4 | 9.2 | 9.3 |
| Losses (gram) | 1.7 | 2.7 | 2.6 | 7.1 | 8.3 | 2.2 | 4.3 |
| Yield (gram) | 100.0 | 100.0 | 100.0 | 100.0 | 100.0 | 100.0 | 100.0 |
| | A | | | | E | | |
| Theoretical HLB | 7.6 | 7.2 | 8.2 | 7.9 | 7.7 | 7.5 | 8.5 |
| Contact angle (° C.) | n.d. | n.d. | n.d. | n.d | n.d. | n.d. | n.d. |
| Specifications of resin | | | | | | | |
| AV (mg KOH/g) | 3.7 | 26.6 | 1.0 | 3.2 | 2.0 | 30.2 | 8.0 |
| OHV (mg KOH/g) | 10.8 | 20.0 | 10.0 | 18.5 | n.d | 20.1 | 8.2 |
| Mn (g/mol) | 11000 | 4400 | 7800 | 8000 | 6300 | 5900 | 6600 |
| Tg (° C.) | −16 | 27 | 52 | 25 | 6 | 34 | 11 |
| Tm (° C.) | 110 | — | — | — | 99 | — | — |
| Tc (° C.) | 45 | — | — | — | — | — | — |
| Specification of dispersion | | | | | | | |
| Solids content (%) | 32.5 | 28.4 | 30.0 | 33.8 | 38.4 | 42.6 | 44.4 |
| pH | 3.5 | 7.1 | 6.0 | 5.1 | n.d. | 6.2 | 3.8 |
| Viscosity (mPa · s) | 91 | <2 | 32 | 63 | 10 | 85 | 24 |

-continued

| Compositions and properties of experimental polyesters | | | | | | | |
|---|---|---|---|---|---|---|---|
| particle size (nm (fraction)) | 68 (0.95) 216 (0.05) | 68 (0.92) 194 (0.08) | 72 (1.00) | 68 (0.96) 230 (0.04) | 260 (1.00) | 474 (1.00) | 268 (1.00) |
| | H | | | | L | | |
| Theoretical HLB | 8.1 | 8.0 | 8.2 | 10.4 | 9.3 | 8.7 | 9.3 |
| Contact angle (° C.) | n.d. | 85 | 84 | 76 | 80 | 82 | 81 |
| Specifications of resin | | | | | | | |
| AV (mg KOH/g) | 2.0 | 1.5 | 1.8 | 4.5 | 2.6 | 2.9 | 3.5 |
| OHV (mg KOH/g) | 17.8 | 16.9 | 23.7 | 15.6 | 22.6 | 17.8 | 11.9 |
| Mn (g/mol) | 7500 | 7000 | n.d. | n.d. | n.d. | n.d | n.d |
| Tg (° C.) | 33 | 38 | 27 | 36 | 29 | 28 | 31 |
| Tm (° C.) | — | — | — | — | — | — | — |
| Tc (° C.) | — | — | — | — | — | — | — |
| Specification of dispersion | | | | | | | |
| Solids content (%) | 34.8 | 39.5 | 33.5 | 29.4 | 34.5 | 30.5 | 29.9 |
| pH | 5.4 | 5.4 | 5.6 | 4.1 | 5.1 | 6.9 | 7.1 |
| Viscosity (mPa · s) | 145 | 1700 | 820 | 318 | 145 | 1443 | 128 |
| particle size (nm (fraction)) | n.d. | 71 (1.00) | 69 (1.00) | 71 (1.00) | 276 (1.00) | n.d. | n.d |

Abbreviations in Table 1:
IPA = isophtalic acid

TPA=terephtalic acid
SSIPA=5-sodiosulfo isophthalic acid
DEG=diethylene glycol
TMP=Trimethylolpropane
CHDM=cyclohexane dimethanol
1,6 HD=1,6 hexane diol
NPG=neopentyl glycol
EG=ethylene glycol
MP-diol=2-Methyl-1,3-propanediol
TBT=tetrabutyl titanate
DBTO=dibutyltin oxide
MBTO=monobutyltinoxide
AV=acid value
OHV=hydroxyl value
Mn=number average molecular weight As a mere example, here below The Davies' method is described in detail for the calculation of the HLB value of resin K. The basic formula is given by:

$$HLB = 7 + \sum_{i=1}^{m} H_i - n \times 0.475$$

where:
m—Number of hydropilic groups in the molecule
$H_i$—Value of the $i^{th}$ hydrophillic groups (see tables)
n—Number of lipophilic groups in the molecule The amount of raw materials used for synthesis (note: catalyst and additives are not included in the calculation): 17.6 gram SSIPA, 49.7 gram IPA (isophtalic acid), 23.1 gram CHDM (cyclohexane dimethanol), 29.7 gram DEG (diethylene glycol) (of which 7.1 gram will be removed during the synthesis). Final resin composition: 17.6 gram SSIPA, 49.7 gram IPA, 23.1 gram CHDM, 22.6 gram DEG. The molar fractions of raw materials were calculated based on 1 mol resin (Table 2).

TABLE 2

| Final resin composition of resin K | | | | |
|---|---|---|---|---|
| | weight | MW | mol | mol fraction |
| SSIPA | 17.6 | 268 | 0.066 | 0.089 |
| IPA | 49.7 | 166 | 0.299 | 0.405 |
| DEG | 22.6 | 106 | 0.213 | 0.289 |
| CHDM | 23.1 | 144 | 0.160 | 0.217 |
| SUM | | | 0.739 | 1.000 |

The contribution of the lipophilic groups was calculated based on the molar fractions.

Lipophilic groups are: —CH—, —$CH_2$—, $CH_3$—, =CH—

The group number contribution according to Davies' method is −0.475. The number of lipophilic groups of SSIPA, IPA, DEG and CHDM is respectively 6, 6, 4 and 8. The total contribution of lipophilic groups is 2.78 (Table 3).

TABLE 3

| Contribution of lipophilic groups of resin K | | | | | |
|---|---|---|---|---|---|
| | mol | number | total | group number | contribution |
| SSIPA | 0.089 | 6 | 0.53 | | |
| IPA | 0.405 | 6 | 2.43 | | |
| DEG | 0.289 | 4 | 1.15 | | |
| CHDM | 0.217 | 8 | 1.74 | | |
| SUM | | | 5.86 | 0.4750 | 2.78 |

The contribution of hydrophilic groups was based on the molar fractions.

The hydrophilic groups are: formed ester bounds via condensation reactions, —$SO_3Na$ from the SSIPA, an ether bound from DEG, and the end-groups of the polyester resin (—OH and —COOH).

The groups number contribution of these groups can be found in Table 4.

TABLE 4

Contribution of the hydrophilic groups of resin K

| Hydrophilic groups | | group number | contribution |
|---|---|---|---|
| ester | 0.988 | 2.4 | 2.37 |
| —SO3Na | 0.089 | 37.4 | 3.32 |
| —O— | 0.289 | 1.3 | 0.38 |
| —OH | 0.0383 | 1.9 | 0.07 |
| —COOH | 0.0111 | 2.1 | 0.02 |
| SUM | | | 6.17 |

The ester groups were calculated using the amount of acid, 0.405 mol IPA and 0.089 mol SSIPA (total of 0.494 mol). Both raw materials have two reactive COOH groups. The total results in 0.988 mol COOH and thus maximal 0.988 mol ester can be formed in the resin composition.

For the —$SO_3Na$ group of SSIPA a value of 37.4 was assumed, based on distracting the ether-group contribution (1.3) from the —$SO_4Na$ group contribution (38.4), resulting in a value of 37.4.

The end-groups of the resin were calculated based on the measured acid value (from carboxyl groups), hydroxyl value and theoretical molecular weight. First, the number of ester bounds per chain length was determined. This was done by calculation the average molecular weight of a repeating unit -[acid-glycol]-, assuming that two water molecules were formed during reaction. The average acid molecular weight was 150 g/mol and the average glycol molecular weight was 120 g/mol. This means that the molecular weight of the repeating unit is 270 g/mol.

Resin K has an acid value (AV) of 4.5 mg KOH/g and a hydroxyl value (OHV) of 15.6 mg KOH/g. Based on these functional groups the theoretical molecular weight is 5582 g/mol (MW=(F×56100)/(AV+OHV), where F is the resin functionality (in case of linear resins F=2). This means that there are 5582/270=approx. 20 repeating units in a polymer chain. Each repeating -acid-glycol- unit results in the formation of 2 ester bounds. So, it total there are 40 ester bounds present. Each linear chain has 2 end-groups, so the ratio ester bounds (40) versus end-groups (2) is 20:1. The number of ester bounds used in the composition of the HLB calculation 0.988. So, the total number of end-groups in this composition is 0.988/20=0.0494. Using the end-group ratio AV versus OHV of 4.5/15.6, it means that the —COOH contribution is (4.5×0.0494)/20.1=0.0111 and —OH contribution is (15.6×0.0494)/20.1=0.0383

The final HLB value of resin K was calculated according to the formula give in the Davies's method: HLB=7+6.17-2.78=10.4.

Example 2

The static contact angle can be measured by a contact angle goniometer (KSV CAM 200, available from MechSE, Illinois) using an optical subsystem to capture the profile of a pure liquid on a solid substrate. The substrate needs to be smooth (flat), possibly through polishing if needed as is commonly known. The angle formed between the liquid-solid interface and the liquid-vapor interface is the contact angle. One may use a microscope optical system with a back light. Current-generation systems employ high resolution cameras and software to capture and analyze the contact angle. Static contact angles are obtained at room temperature, wherein the angle is measured 30 seconds after the liquid (water) is applied to the surface. See also Volpe et al in: *Contact Angle, Wettability and Adhesion,* 4: 79-100 C. D, 2006, *"About the possibility of experimentally measuring an equilibrium contact angle and its theoretical and practical consequences".*

For some polyesters as depicted in Table 1 the static contact angle has been measured. The values are provided again here below in Table 5.

TABLE 5

Static contact angle of various polyesters (after 30 seconds, RT)

| Resin | HLB | Contact angle |
|---|---|---|
| I | 8.0 | 85° (84.7 ± 0.7) |
| J | 8.2 | 84° (84.4 ± 0.5) |
| K | 10.4 | 76° (75.9 ± 0.2) |
| L | 9.3 | 80° (79.7 ± 1.1) |
| M | 8.7 | 82° (81.8 ± 0.8) |
| N | 9.3 | 81° (80.9 ± 0.8) |

Example 3

Tuft Bind

The tuft bind, also referred to as tuft bind strength, can be measured according to test method ASTM D1335-12, which is a standard test method for determining the tuft bind of pile yarn floor coverings. In this test, a test sample is mounted in a special clamping fixture to the base of a tensile testing machine. A hook (for loops specimen) or a tuft clamp (for cut pile specimen) are used to remove a specimen from the sample. The force to pull the specimen free from the test sample is measured as the tuft bind. For the data in the present patent application the Lloyd Ametek LS1 Tensile Tester is used with the following settings: Tuft clamp, Speed 300 mm/min, temperature 23° C., humidity ~64%.

Tuft Bind after Exposure to Water

For establishing durability of the tuft bind under conditions of high moist, a test was developed to measure the tuft bind after exposure of the textile product to water. For this a sample (round, area of 100 cm2) is submerged in water. In a first type of test the sample is submerged in a container filled with cold water (600 ml) for 5 minutes (20° C.), and in the second type of test the sample is submerged in a container filled with warm water (600 ml) for 5 minutes at 50° C. The tuft bind strength is best determined before the submerging process, right after submerging (within 5 minutes, thus using wet samples, containing approximately 150-200% water) and after four days of drying at room temperature and atmospheric pressure. The tuft bind itself is measured as described here above according to ASTM D1335-12.

Resistance Against Delamination

For determining the resistance against delamination of a secondary back, also referred to as "Delamination strength" the test method ASTM D3936-05 is used, which is a standard test method for resistance to delamination of the secondary backing of pile yarn floor covering. In the test a specimen is separated manually for a distance of about 38 mm (exactly 1.5 inch). Each layer then is placed in opposing clamps of a tensile tester, and the force to continue the separation for a specified distance is recorded. The peak forces in specified length intervals are averaged and the resistance to delamination calculated. The equipment used is the same Lloyd Ametek LS1 Tensile Tester as referred to here above with the following settings: test type tear—180°, cross-head speed 300 mm/min, propagation speed 150 mm/min, width sample 50 mm, sample area 5600 $mm^2$, temperature 23° C., humidity ~64%.

Taber Test

The Taber test is a method as published by SAE International and denoted as a test method for determining resistance to fiber loss, resistance to abrasion and bearding of automotive carpet materials. The SAE International code for the test is SAE J1530. Common settings are: 2000 cycles, H18 wheels, climate chamber (temperature 23° C. and humidity 50%). The carpet samples are rounds with a surface area of 100 $cm^2$.

Velcro Test

This test is commonly used to look for deficiencies in a carpet system with respect to filament binding, i.e. the binding of the small (individual) fibers in the yarns. It is a qualitative test which uses a device which consists of a weighted roller with a specific Velcro surface applied to the surface of the roller. The sample is visually assessed for the level of fuzzing after rolling a predetermined number of times over the sample. The test is only appropriate for looped-pile carpets, as the Velcro is not able to grasp cut-pile filaments.

Foaming Volume of a Dispersion 100 ml liquid dispersion was foamed and the volume increase was measured using a graduated cylinder.

Example 4

Glass Transition Temperature

The glass transition temperature (Tg) of a polymer can be measured by using the standard test method for assignment of the glass transition temperatures by Differential Scanning Calorimetry (DSC) ASTM E1356-08(2014). This method using DSC provides a rapid test method for determining changes in specific heat capacity in a homogeneous material. The glass transition is manifested as a step change in specific heat capacity. The method is suitable for amorphous and semi-crystalline materials.

The Tg was measured by DSC using the TA Instruments DSC Q1000 with the standard TA Instruments alumina cups of 50 μl. The flow rate was 50 ml/min of nitrogen and the sample was loaded at a temperature range 20 to 25° C. For amorphous polyesters, the sample was then cooled to −20° C., at −20° C. the sample was heated to 60° C. at a rate of 5° C./min. For semi-crystalline polyesters, the sample was cooled to −50° C., at −50° C. the sample was heated to 200° C. at a rate of 5° C./min, followed by an isothermal step of 1 minutes at 200° C. and subsequently a cooling step from 200° C. to −50° C. at a rate of 5° C./min.

Particle Size

The particle size of polyester particles in a dispersion can be determined using a Malvern Mastersizer 3000, which can accurately determine particle size and their distribution in the range of 10 nm to 3500 μm. Particle size measurements are done with the angular diffraction of a red (632.2 nm) and blue (470 nm) laser using an array of 60 detectors. The samples are diluted in water to 1-7% obscuration and measured after 3 minutes equilibration at room temperature with 25% ultrasonic power and 3000 rpm stirring. The results are the averages of three measurements of 30 seconds. Particle size (spherical) can be calculated according the Mie (ISO 13320) and Fraunhofer theory. The result is generated automatically via the software provided by the instrument supplier.

Molecular Weight

In order to determine the molecular weight and molecular weight distribution of a polymer, the method applied to obtain the data for the current polymer materials is gel-permeation chromatography. The number molecular weight (Mn) of a polymer is determined using Size Exclusion Chromatography (SEC) with a mixture of tetrahydrofuran/water/lithium bromide/acetic acid (1000/30/5/1) as the eluent. The molecular weight calculations were done based on polystyrene standards.

Solids Content of a Dispersion

The solids content of a dispersion can be measured by heating a sample of a known mass using a halogen dryer (such as e.g. Halogen Moisture analyzer HR73) at elevated temperatures (160° C. for the current polyester dispersions), dispensed on a glass fiber pad of a known weight until constant weight indicating that all solvent is removed. The mass of the solids can then be easily determined.

Viscosity of a Dispersion

The viscosity of a dispersion can be measured using a Brookfield viscometer equipped with a small sample adapter and spindle SC4-21. For the current dispersions a water bath controlled at 23.0° C. is used, and a cup characterised as Chamber 13R, Diameter=19.05 mm, Depth=64.77 mm. The procedure is as follows:

Attach spindle S21 to the viscometer;

Fill the cup with about 8 ml dispersion;

Place the cup in the Brookfield viscometer;

Start the viscometer at a speed of 20 rpm and read the viscosity; This specific combination of spindle and speed should results in a viscosity measurement range of 23-230 mPa·s. When the viscosity is <23 mPa·s change the speed to 50 rpm; When the viscosity is >230 mPa·s change the speed to 10 rpm and read the viscosity (viscosity range 47-468 mPa·s), if still too high adjust to 5 rpm (viscosity range 94-936 mPa·s), if still too high adjust to 0.5 rpm (viscosity range 936-9360 mPa·s)

Condition the dispersion at 23° C. by waiting until the viscosity reading has stabilised.

Stop the rotation. Restart the motor and repeat measurement again. Measurements should not differ more than 3% relative from each other.

Example 5

In this example methods of making different dispersions of polyester polymer, ranging from relatively low HLB (8.0 to high HLB (10.4).

Polyester Resin I (HLB 8.0)

Synthesis

A polyester was prepared using a standard polyester synthesis as described below. The ingredients 5-(sodiosulfo) isophthalic acid (50 g), 2-methyl-1,3-propanediol (229 g), ethylene glycol (32 g), sodium acetate (0.13 gr), butyl stannoic acid (0.50 g) and lithium hydroxide (0.13 g) were heated in a reactor at 200° C. Water produced during the reaction was removed until the acid number of the mixture was less than 1 mg KOH/g and then the reactor was cooled to 160° C.

Decanedioic acid (50 g; =sebacic acid), isophthalic acid (352 g) and recycled PET (407 g) were added to the reactor and the mixture was heated to 250° C. Water from the reaction was removed until the acid number of the mixture was less than 25 mg KOH/g and then the reactor was cooled to 240° C. The remaining water was removed under reduced pressure until the acid number was less than 5 mg KOH/g to produce a polyester characterised as follows: Hydroxyl value=16.9 mg KOH/g, Acid value=1.5 mg KOH/g; Tg=38° C., contact angle=85°

Dispersion of Resin I

The polyester resin (200 gram) was dissolved in methyl ethyl ketone (MEK) (200 g) in a reactor at 60° C. In 30 minutes demineralised water (341 g) was added while stirring. Sodium acetate (0.2 g) was added to the mixture. A vacuum was applied to remove MEK. The pH was set above 5.0 (preferably it is between 5.0 and 8.0) by adding sodium hydroxide.

The polyester dispersion was characterised as follows: Solids content=39.5%, viscosity=1700 mPa·s, pH=5.4 and particle size=71 nm, residual MEK was below detection limit of 0.001%.

Polyester Resin K (HLB 10.4)

Synthesis

A polyester was prepared using a standard polyester synthesis as described below. The ingredients 5-(sodiosulfo) isophthalic acid (SSIPA) (176 g) and demineralised water (352 g) were heated in a reactor at 60° C. to dissolve the SSIPA. Diethylene glycol (297 g), 1,4-cyclohexanedimethanol (231 g), lithium hydroxide (0.15 g) and butyl stannoic acid (0.50 g) were added to the reactor and the mixture was heated to 220° C. Water was removed until the acid number of the mixture was less than 1 mg KOH/g and then the reactor was cooled to 160° C. Isophthalic acid (497 g) was added to the reactor and the mixture was heated to 240° C. Water formed during the reaction was removed until the acid number of the mixture was less than 25 mg KOH/g. The remaining water was removed under reduced pressure until the acid number was less than 5 mg KOH/g to produce a polyester characterised as follows: Hydroxyl value=15.6 mg KOH/g, Acid value=4.5 mg KOH/g; Tg=36° C., contact angle=76.0°

Dispersion from Resin K 422 g demineralised water was heated in a reactor to 70° C. Polyester resin (173 g), grinded into fine powder (<1 μm particles) using a grinding machine, was added to the reactor. The mixture was heated for 1 hour. If necessary, the pH can be increased by adding for example sodium hydroxide or sodium acetate.

The polyester dispersion was characterised as follows: Solids content=29.4%, viscosity=318 mPa·s, pH=4.1 and particle size=71 nm

Example 6

The present dispersion of polyester particles can be used to make any type of textile product, in particular carpet type products. The dispersion appears to be suitable to be used in art-known methods that are designed to apply a thermoplastic polymer coating in order to function as a binder for durably connection yarns to a primary backing. Such methods are commonly known in the art. As a mere example, we refer to US 2018/0119339 (Mashburn and Tambasco, filed Nov. 1, 2016), which in general describes a method comprising applying a quantity of an aqueous dispersion of thermoplastic polymer particles to a primary backing and loop backs of a tufted carpet or a tufted synthetic turf, wherein the thermoplastic particles have an average particle size less than 1,000 microns. The method also comprises heating the aqueous dispersion to a temperature sufficient to remove water therefrom, and heating the thermoplastic particles on the primary backing and loop backs to a temperature at or above the melting temperature of the thermoplastic particles. The method further comprises allowing the heated thermoplastic polymer particles to cool below their melting temperature whereby the loop backs are adhered to the primary backing.

The method is exemplified in detail in the Detailed Description Of The Disclosed Embodiments in the '339 patent application, which starts in paragraph [0019] with "Referring now to the drawing . . . " and ends in paragraph [0045], page 5, right hand column with " . . . into the primary backing". The description refers to FIG. 1 of the '339 patent application which is a schematic view of an apparatus for preparing carpet or synthetic turf using the said adhesive system based on an aqueous dispersion of thermoplastic polymer particles. The disclosed apparatus and method are equally suitable for applying the aqueous dispersion of the present invention.

Example 7

This example describes several carpet examples as used in the examples 8 through 18. The samples are as provided here below, using the following technical terms:

"Gauge" is the distance between the needles in inches. For example, ⅛" means that there are 8 needles per inch (i.e. 8 needles per 2.54 cm).

"Stitch rate" (or stitches per 10 cm) defines the number of times an individual needle inserts a tuft into the primary backing for a length of 10 cm.

"Pile weight" is the weight (gram) of the tufts and primary backing per square metre.

"Pile height" is the length (expressed in cm) of the tuft from the primary backing to the tip.

Carpet A: Polyester cut-pile carpet
Construction: gauge 1/10 ", stitch rate 45/10 cm, pile weight 1730 g/m$^2$, pile height 1.0 cm
Carpet B: polyester cut-pile carpet
Construction: gauge 1/10 ", stitch rate 58/10 cm, pile weight 2310 g/m$^2$, pile height 1.0 cm
Carpet C: Polyester loop-pile carpet
Construction: gauge 1/7 ", stitch rate 42/10 cm, pile weight 1060 g/m$^2$, pile height 1.0 cm
Carpet D: Polyester combined cut/loop-pile carpet
Construction: gauge ⅛ ", stitch rate 40/10 cm, pile weight 980 g/m$^2$, pile height 0.7 cm
Carpet E: Polyester cut-pile carpet
Construction: gauge 1/10 ", stitch rate 40/10 cm, pile weight 975 g/m$^2$, pile height 0.7 cm
Carpet F: Polyester cut-pile carpet
Construction: gauge ⅛ ", stitch rate 70/10 cm, pile weight 1460 g/m$^2$, pile height 0.8 cm All examples (when applicable, see below) used a Grey polyester secondary backing, 350 g/m$^2$ of the Supplier TWE (material number 707385).

The carpet samples were used in the following examples as indicated here below.

Carpet A is used in Example 10.
Carpet B is used in Example 11.
Carpet C is used in Examples 8, 9, 10, 12, 14, 15 and 16.
Carpet D is used in Examples 13 and 17
Carpet E is used in Example 18.
Carpet F is used in Example 15.

Example 8

Purpose

The aim of this experiment was to test the applying of polyester dispersions per se. The tests were performed at the TFI test institute in Germany using a small-scale coating line, devised to test (latex) samples for carpet producers. The purpose of this was to test several polyester dispersions on TFI equipment to collect knowledge about the foaming and application process of the current dispersions and the type of latex used in the market, and to compare in-house application methods using a paint roller and the TFI small-scale coating line.

Materials

- Polyester tufted primary backing, loop-pile (see Example 7).
- TFI mall-scale coating line: all samples were pre-coated with the same line speed and height off the blade (or block) to dose the amount of foamed dispersion.
- Kitchen mixing machine.
- Ventilated oven.
- Weight balance.
- Foaming additive: BAYGARD FOAMER (0.25-1.0%).
- Laminator: Lacom MBPL-600 Pilot—Laminator.
- Secondary backing: polyester material (supplier TWE), 350 g/m2 (see Example 7).
- Polyester hotmelt adhesive (DSM).

Methods

Pre-Coat Applied Using Small-Scale Coating Line

- The dispersion was mixed for 3 minutes by use of a kitchen mixing machine to create a foam. In some cases it was needed to add a foaming additive (see below).
- The foamed dispersion was applied on the back side of the carpet by use of sliding blade. The amount that was needed to pre-coat the carpet was calculated using the solids content of the dispersion.
- The carpet was dried in the ventilated oven for 8 minutes at 150° C.
- The samples were cooled down at and to room temperature.
- Then the pre-coat tuftbind (N) was measured.

Lamination of Pre-Coated and Untreated Tufted Primary Backing

- Settings laminator: Speed 8 m/min, oil temperature 140° C., Gaps between the rollers depend on the amount of hotmelt adhesive needed (range 0.3-0.5 mm).
- Applied amount of polyester hotmelt adhesive is around 150 g/m2.
- Then the laminating tuftbind (N) was measured.

Polyester dispersions

- Latex A: Blend of carboxylated styrene-butadiene and polyester (ratio 75/25), solids content (SC) is ~42%
- Latex B 37% solids (~8 w % is inorganic material and ~29 w % is organic material. The inorganic part consists possibly of $BaSO_4$, $TiO_2$, $CaCO_3$ and $Al_2SiO_5$ used as fillers. The organic part consists possibly of a blend of a carboxylated saturated polyester and a bisphenol-A based epoxy. Di-ethanol amine used as neutralizing agent.
- Dispersion from resin A (HLB of 7.6)
- Dispersion from resin B (HLB of 7.2)
- Dispersion from resin C (HLB of 8.2)
- Dispersion from resin D (HLB of 7.9)

The dispersion from resin B is stabilised with a volatile amine (dimethylethanolamine) because of the high amount of carboxylic groups. The amine will (at least partly) evaporate (as a so-called VOC, a volatile organic compound) during the manufacturing process of the final carpet product, which is disadvantageous. Resin B has a relatively high acid value which decreases its long term stability.

Results

The results for the tuft bind obtained after applying a pre-coat only, and after lamination are given in Table 6. Also the force needed for delamination is provided. The reference material is the "tufted-only" primary backing (no pre-coat applied).

TABLE 6

Tuftbind of various carpet samples (all in N), before and after lamination

| | pre-coat coat weight (g/m2) | pre-coat tuftbind | laminating Tuftbind | delamination (N) |
|---|---|---|---|---|
| REF | — | 5 ± 1 | 19 ± 2 | 45 |
| Latex A | 132 | 14 ± 7 | 31 ± 4 | 52 |
| Latex B | 164 | 8 ± 1 | 23 ± 5 | 103 |
| Dispersion from | | | | |
| Resin A | 210 | 20 ± 5 | 40 ± 6 | 43 |
| Resin B | 114 | 22 ± 6 | 37 ± 7 | 51 |
| Resin C | 84 | 12 ± 4 | 33 ± 10 | 59 |
| Resin D | 62 | 11 ± 2 | 34 ± 8 | 63 |

Conclusions

- Latex A: foaming additive needed (otherwise no stable foam was created→penetration through carpet), two pre-coat layers were applied to obtain enough weight (no drying in between)
- Latex B: difficult to foam, hardly any volume increase, 1 pre-coat layer resulted in enough layer thickness, after drying a fine powder came off the carpet.
- Dispersion from resin B: no foam without additive, 2 layers applied to obtain sufficient layer thickness.
- Dispersion from resin A: foaming additive needed, pre-coat layer flows of the carpet, was difficult to spread equally, difficult to remove the water (long drying time), 1 pre-coat layer was enough.
- Dispersion from resin D: no stable foam without additive, adding 0.5% gave still foam with poor stability, 2 pre-coat layer applied.
- Dispersion from resin C: no foaming additive was needed, 2 pre-coat layers.
- Polyester pre-coat dispersions seem to outperform the two latex references with respect to tuftbind strength.
- Strong improvement tuftbind strength after lamination.
- Comparable results of application methods (paint roller vs TFI).
- Even a pre-coat weight of 62 g/m2 is enough to obtain good properties (dispersion from resin D.

Example 9

Purpose

The purpose of this experiment was to compare the obtainable tuftbind strength of pre-coated carpet using different polyester samples (including a reference sample from the market) and to compare the method of applying pre-coat, viz spray versus roller, liquid versus foam.

Materials

- Polyester tufted primary backings (35×35 cm), loop-pile (see Example 7).
- Kitchen mixing machine (3 liter), type Bestron® AKM900SDM
- Ventilated oven, Memmert UF1060
- Paint roller (10 cm), plant sprayer (500 ml)
- Weight balance
- Polyester dispersions:
  - Latex A: blend of carboxylated styrene-butadiene and polyester (ratio 75/25)
  - Dispersion from resin A (HLB of 7.6)

Dispersion from resin B (HLB of 7.2): 70 or 100% neutralization with DMEA (dimethylethanolamine)

Dispersion from resin D (HLB of 7.9)

Methods

Pre-Coat Applied Using a Paint Roller

The dispersion was mixed for 3 minutes by use of a kitchen mixing machine to create a foam.

The foamed dispersion was applied on the back side of the carpet by use of a paint roller. The amount that was needed to pre-coat the carpet was calculated using the solids content of the dispersion.

The carpet was dried in the ventilated oven for 8 minutes at 150° C.

The samples are cooled down and to room temperature.

Pre-Coat Applied Using a Plant Sprayer

The plant sprayer was filled with the dispersion as such.

The dispersion was sprayed on the back side of the carpet. The amount that was needed to pre-coat the carpet was calculated using the solids content of the dispersion.

The carpet was dried in the ventilated oven for 8 minutes at 150° C.

The samples are cooled down at and to room temperature (further described as "to room temperature").

Pre-Coat Applied as Liquid

The liquid dispersion was applied on the back side of the carpet by using a paint roller. The amount that was needed to pre-coat the carpet was calculated using the solids content of the dispersion.

The carpet was dried in the ventilated oven for 8 minutes at 150° C.

The samples are cooled down to room temperature.

Results

The results for the tuft bind obtained are given in Table 7.

TABLE 7

| pre-coated sample # | dispersion from | Dispersion | application method | coat weight (g/m2) | tuftbind strenght (N) | pre-coated carpet appearance |
|---|---|---|---|---|---|---|
| I | Latex A | liquid | liquid - spraying | 101 | 21 ± 4 | |
| II | Latex A | liquid | liquid - spraying | 171 | 25 ± 2 | |
| III | Resin B (70%) | liquid | liquid - roller | 147 | 25 ± 7 | leaked through the carpet |
| IV | Resin B (70%) | foamed | roller | 147 | 21 ± 3 | |
| V | Resin B (100%) | foamed | roller | 260 | 33 ± 5 | |
| VI | Resin B (100%) | liquid | spray | 217 | 24 ± 4 | |
| VII | Resin B (70%) | foamed | roller | 229 | 36 ± 6 | |
| VIII | Resin A | liquid | spray | 103 | 14 ± 3 | |
| IX | Resin D | foamed | roller | 204 | 38 ± 2 | |

Conclusions

Application method using a paint roller: Liquid (sample Ill) versus foamed dispersion (sample IV): no significant difference in tuftbind strength, but when the dispersion is applied as a liquid it will leak through the carpet. This means that a foaming step is preferred.

No significant difference in tuftbind strength was observed between the two application method: spraying versus applying foamed dispersion via a roller. But spraying is typically applied when the particles are relatively small to prevent blocking of the spraying holes may occur.

The carpet sample pre-coated with a semi-crystalline polyester (sample VIII) showed a lot of variation in layer thickness since it was difficult to spray a fine mist with this dispersion.

Example 10

Purpose

The purpose of this example was to test the influence of the pre-coat layer thickness (50 vs 100 g/m2) and to test different kinds of paint roller (fur roller versus lacquer roller)

Materials

Two types of polyester tufted primary backing (size 50×44 cm): loop-pile and cut pile (see Example 7).

Kitchen mixing machine (3 liter), type Bestron® AKM900SDM.

Ventilated oven, Memmert UF1060.

lacquer roller (10 cm), fur roller (25 cm).

Weight balance.

Foaming additive: Empigen BB detergens (N,N-dimethyl-N-dodecylglycine betaine).

Laminator: Lacom MBPL-600 Pilot—Laminator.

Secondary backing: polyester material (supplier TWE), 350 g/m2.

Polyester hotmelt adhesive (DSM)

Dispersion from resin D (HLB of 7.9)

Dispersion from resin E (HLB of 7.7)

Methods

Pre-Coat of Polyester Tufted Primary Backing

The dispersion was mixed for 3 minutes by use of a kitchen mixing machine to create a foam. Dispersion from resin E needed a foaming additive to create a stable foam (sample A1 and A2 0.3% and sample A4 0.7%)

The foamed dispersion was applied on the back side of the carpet by use of a paint roller, either a lacquer roller or a fur roller. The amount that was needed to pre-coat the carpet was calculated using the solids content of the dispersion.

The carpet was dried in the ventilated oven for 8 minutes at 150° C.

The samples are cooled down to room temperature.

Then the pre-coat tuftbind (N) was measured.

Lamination of Pre-Coated and Untreated Tufted Primary Backing

Settings laminator: Speed 8 m/min, oil temperature 140° C., Gaps between the rollers depend on the amount of hotmelt adhesive needed (range 0.3-0.5 mm).

Applied amount of polyester hotmelt adhesive is around 250 g/m2.

Then the after lamination tuftbind (N) was measured.

Results

The results are given in Table 8

TABLE 8

Tuftbind results, before and after lamination

| Pre-coat Code | Carpet | Dispersion from | g/m2 coat weight | pre-coat Tuftbind strength (N) | ± | after lamination Tuftbind strength (N) | ± |
|---|---|---|---|---|---|---|---|
| I | Cut pile | Resin E | 95 | 9.1 | 2.6 | 13.6 | 3.5 |
| II | Cut pile | Resin E | 64 | 6.1 | 1.9 | 14.2 | 3.9 |
| III | Cut pile | Resin D | 105 | 15.5 | 3.3 | 18.4 | 3.5 |
| IV | Cut pile | Resin D | 55 | 11.8 | 2.3 | 14.6 | 2.1 |
| V | Cut pile | — | — | 1.0 | 0.2 | 9.2 | 3.2 |
| VI | Loop pile | Resin E | 55 | 15 | 15 | 20.6 | 5.8 |
| VII | Loop pile | Resin D | 50 | 8.5 | 2.4 | 18.8 | 2.7 |

Conclusions

- Better tuftbind results were obtained with the amorphous resin (sample Ill and IV) compared to semi-crystalline (sample I and II)
- Comparable results obtained with the 'fur roller' compared to the lacquer roller
- Using only a hotmelt adhesive and applying no pre-coat provided a low tuftbind strength (sample V)
- Thicker pre-coat layer gives higher tuftbind strength, but after lamination this difference in pre-coat layer is less significant.
- In this series to create a stable foam with the semi-crystalline polyester dispersion (resin E) an additive is needed.

Example 11

Purpose

The purposes of this experiment was to assess the effect of the solids content (SC) of the dispersion on tuftbind strength, as well as the effect of viscosity of the dispersion on the foaming behavior and stability. Also, a potential change in tuftbind strength in time was assessed, both after a pre-coat only is applied and after lamination. Lastly, the tuftbind strength was tested after 2 weeks storage of a pre-coated sample at elevated temperatures.

Materials

- Polyester tufted primary backing (size 35×30 cm): cut-pile (see Example 7).
- Kitchen mixing machine (3 liter), type Bestron® AKM900SDM.
- Ventilated oven, Memmert UF1060.
- Paint roller (10 cm).
- Weight balance.
- Foaming additive: Empigen BB detergens (N,N-dimethyl-N-dodecylglycine betaine).
- Laminator: Lacom MBPL-600 Pilot—Laminator.
- Secondary backing: polyester material (supplier TWE), 350 g/m2.
- Polyester hotmelt adhesive (DSM).
- Dispersion from resin D (HLB of 7.9).
- Dispersion from resin E (HLB of 7.7) solids content of the dispersion was varied from 44.3% (viscosity of 139 mPa·s) to 34.1% (viscosity 5 mPa·s) by adding extra water to the dispersion. Sample E-5 contained extra sodium acetate (total 0.25 wt %).
- Dispersion from resin F (HLB of 7.5): 80% neutralization with DMEA.
- Dispersion from resin G (HLB 8.5).

Methods

Pre-Coat of Polyester Tufted Primary Backing

- The dispersion was mixed for 3 minutes by use of a kitchen mixing machine to create a foam.
- The foamed dispersion was applied on the back side of the carpet by use of a paint roller. The amount that is needed to pre-coat the carpet was calculated using the solids content of the dispersion.
- The carpet was dried in the ventilated oven for 8 minutes at 150° C.
- The samples were cooled down to room temperature.

Lamination of Pre-Coated Tufted Primary Backing

- Settings laminator: Speed 4 m/min, oil temperature 140° C., Gaps between the rollers depend on the amount of hotmelt adhesive needed (range 0.3-0.5 mm).
- Applied amount of polyester hotmelt adhesive is around 400 g/m2.

Results

The results are given in Tables 9 and 10 here below.

TABLE 9

Viscosity and foaming behaviour of various dispersions

| Dispersion from | SC (%) | viscosity (mPa · s) | Foaming |
|---|---|---|---|
| Resin E-1 | 44.3 | 139 | easy to foam/stable foam |
| Resin E-2 | 41.9 | 24 | poor foam, but no additive needed |
| Resin E-3 | 37.0 | 7 | poor foam, but no additive needed |
| Resin E-4 | 34.1 | 4 | difficult to foam/not stable –> ~0.5% foaming additive |
| Resin E-5 | 34.1 | 7 | difficult to foam/not stable –> ~0.5% foaming additive |
| Resin G | 44.3 | 29 | difficult to foam/no stable foam (hardly any volume increase possible) |
| Resin F | 42.6 | 85 | easy to foam/stable foam |
| Resin D | 33.8 | 63 | easy to foam/stable foam |

TABLE 10

Tuftbind strength before and after lamination

| Dispersion from | amount pre-coat (g/m2) | Tuftbind strenght (N) pre-coat | stdev | Tuftbind strenght (N) after lamination | stdev |
|---|---|---|---|---|---|
| Resin E-1 | 100 | 7.1 | 2.0 | 11.6 | 2.9 |
| Resin E-2 | 100 | 8.1 | 1.0 | 13.0 | 4.1 |
| Resin E-3 | 100 | 6.8 | 1.6 | 10.5 | 1.7 |
| Resin E-4 | 100 | 7.4 | 1.9 | 10.2 | 2.3 |
| Resin E-5 | 100 | 8.5 | 1.7 | 12.9 | 2.6 |
| Resin G | 100 | 7.6 | 0.9 | 15.5 | 3.3 |
| Resin G | 50 | 8.4 | 3.4 | 13.2 | 4.0 |
| Resin F | 100 | 6.8 | 2.1 | 14.9 | 4.1 |

TABLE 10-continued

| Tuftbind strength before and after lamination | | | | | |
|---|---|---|---|---|---|
| Dispersion from | amount pre-coat (g/m2) | Tuftbind strenght (N) pre-coat | stdev | Tuftbind strenght (N) after lamination | stdev |
| Resin F | 50 | 5.8 | 2.6 | 10.4 | 5.0 |
| Resin D | 100 | 9.1 | 2.2 | 17.5 | 3.2 |
| Resin D | 50 | 6.0 | 2.5 | 13.0 | 2.5 |

Conclusions

Foaming of semi-crystalline resin E depends on viscosity:
- 139 mPa·s: easy to foam and stable foam formed
- 5 mPa·s: difficult to foam, instable foam (foaming additive needed)

If the foam is not stable it is more difficult to apply the dispersion equally and to prevent leakage through the carpet.

- Solids content of the dispersion (i.e. viscosity) has no influence on tuftbind strength.
- Tuftbind strength measured 1.5 hr after applying and drying pre-coat is comparable as the tuftbind measured after 24 hr (data not presented).
- Tuftbind after lamination shows no change in time (measured 15 minutes and 1 day after lamination; data not presented).
- Tuftbind strength after 2 weeks storage of the carpet at 50° C. showed no change (data not presented).
- Tuftbind strength of the pre-coated carpet with (relatively) low Tg resin (resin G, Tg around 11° C.) showed comparable results in tuftbind however the pre-coated sample became sticky (in case no backing was applied).
- Apart from the same disadvantageous as Resin B (see above), a HLB value of 7.5 (resin F) leads to a tuft bind strength that is (just) below an acceptable level.

Example 12

Purpose

The purpose of this example was to test the tuftbind strength of dispersion made from resin with a relatively high Tg, i.e. a Tg above RT (room temperature), and the appearance of the carpet (in particular the brittleness) and to test the influence of the viscosity of dispersion.

Materials

- Polyester tufted primary backing (size 35×35 cm): loop-pile (see Example 7).
- Kitchen mixing machine (3 liter), type Bestron® AKM900SDM.
- Ventilated oven, Memmert UF1060.
- Paint roller (10 cm).
- Weight balance.
- Dispersion from resin H (HLB of 8.1)(Tg ~33° C.): The SC was adjusted by changing the amount of water in the dispersion:
  - Dispersion H-1: SC ~40%→viscosity of ~900 mPa·s
  - Dispersion H-2: SC ~38%→viscosity of ~130 mPa·s Methods Pre-Coat of Polyester Tufted Primary Backing

- The dispersion was mixed for 3 minutes by use of a kitchen mixing machine to create a foam.
- The foamed dispersion was applied on the back side of the carpet by use of a paint roller. Approx. 100 g/m2 dried polyester pre-coat was applied on the material.
- The carpet was dried in the ventilated oven for 8 minutes at 150° C.

Results and Conclusions

It appeared that both dispersions were easy to foam, but the foam volume and stability of dispersion H-1 was better compared to dispersion H-2 (no data presented). The carpet pre-coated with lower viscosity seemed to show somewhat more spread in tuftbind strength but the values were slightly higher (pre-coated material with sample H-1: tuftbind 15±3 N and pre-coated material with sample H-2: tuftbind 19±6 N). Both carpet samples show some creaking due the brittleness of the polyester used for the dispersion.

Example 13

Purpose

The purpose of this example was to check whether the current invention may lead to a polyester carpet that passes the commonly used Velcro test. Different amounts of pre-coat were applied, different foam volumes were used and different layers were applied.

Materials

- Polyester tufted primary backing (size 35×30 cm): combined loop-pile and cut-pile (see Example 7).
- Kitchen mixing machine (3 liter), type Bestron® AKM900SDM.
- Ventilated oven, Memmert UF1060.
- Paint roller (10 cm).
- Weight balance.
- Laminator: Lacom MBPL-600 Pilot—Laminator
- Secondary backing: polyester material (supplier TWE), 350 g/m2.
- Polyester hotmelt adhesive (DSM).
- Dispersion from resin H (HLB of 8.1)

Methods

Pre-Coat of Polyester Tufted Primary Backing

- The dispersion was mixed for 3 minutes by use of a kitchen mixing machine to create a foam.
- The foamed dispersion was applied on the back side of the carpet by use of a paint roller. The amount that was needed to pre-coat the carpet was calculated using the solids content of the dispersion.
- The carpet was dried in the ventilated oven for 5 minutes at 150° C.
- The samples were cooled down to room temperature.
- In some cases extra pre-coat layers were applied by repeating the previous steps.

Lamination of Pre-Coated Tufted Primary Backing

- Settings laminator: Speed 4 m/min, oil temperature 140° C., Gaps between the rollers depend on the amount of hotmelt adhesive needed (range 0.3-0.5 mm).
- Applied amount of polyester hotmelt adhesive is around 250 g/m2.

Results

The results are indicated here below in Table 11. For samples I, II and III 200 g/m$^2$ pre-coat was too much, the sample became too stiff. Next to this, the same effect as indicated here above was observed, viz that the layer thickness of the pre-coat layer affects the tuftbind strength, but after lamination the effect is less significant.

Next to this, sample IV was used to check the Velcro test after each layer. After two layers the material passed the Velcro test already, the third layer did not show any improvement (Velcro test was done after each layer). Sample V showed a comparable tuftbind strength as sample IV, using almost a similar amount of pre-coat but applied in 2 layers instead of 3.

With sample VI, using a similar amount of pre-coat as in sample II (~150 g/m$^2$), more or less similar tuftbind strengths were found (also after lamination). This indicates that the number of layer as well as the foam volume has no effect on the tuftbind performance.

Sample II also passed the Velcro test, meaning that 1 layer pre-coat is sufficient.

TABLE 11 tuftbind strength before and after lamination of various test set-ups

| Sample | Amount pre-coat ($g/m^2$) | Foam volume increase | Number of pre-coat layer | Tuftbind strength (N) pre-coat | Tuftbind strength (N) After lamination |
|---|---|---|---|---|---|
| I | 200 | 1× | 1 layer | x | x |
| II | 150 | 1× | 1 layer | 40 | 45 |
| III | 100 | 1× | 1 layer | 32 | 47 |
| IV | 3 × 75 | 4-5× | 3 layers | 55 | X |
| V | 125 + 75 | 4-5× | 2 layers | 56 | 64 |
| VI | 2 × 75 | 4-5× | 2 layers | 37 | 75 |

Conclusions

No additional performance is observed when using multiple layers of pre-coat, nor creating more foam volume of the dispersion.

An amount as low as 100 $g/m^2$ of pre-coat is sufficient to pass the Velcro test.

Example 14

Purpose

The purpose of this experiment was to study the effect of applying the pre-coat in different ways in relation to the obtained tuftbind strength. Also, it was assessed what the effect is, if any, of an extra drying step and the effect of a second pre-coat layer.

Materials

Polyester tufted primary backing (size 35×30 cm) (see Example 7).

Kitchen mixing machine (3 liter), type Bestron® AKM900SDM.

Ventilated oven, Memmert UF1060.

Paint roller (10 cm).

Weight balance.

Dispersion from resin I (HLB of 8.0).

Methods

Pre-Coat of Polyester Tufted Primary Backing

The dispersion was mixed for 3 minutes by use of a kitchen mixing machine to create a foam.

The foamed dispersion was applied on the back side of the carpet by use of a paint roller. Approx. 100 g/m2 dried polyester pre-coat is applied on the material.

The carpet was dried in the ventilated oven for 8 minutes at 150° C.

The samples were cooled down at room temperature

In some cases an extra pre-coat layer was applied by repeating the previous steps Variation in Application Method I. Pre-coat applied in two steps: first 50 g/m2 applied→dried>second 50 g/m2 applied→dried (total pre-coat layer is 100 g/m2)

II. 100 g/m2 pre-coat applied in one step; two drying steps

III. 100 g/m2 pre-coat applied in one step; first drying in oven and second drying by heat gun IV. Reference system: 100 g/m2 pre-coat applied in one step; standard drying step V. No pre-coat applied: only tufted primary backing Results It was found that the tuftbind of sample I is the lowest (16±6 N), sample II, Ill and IV have more or less comparable results in tuftbind (25±8, 23±5 and 24±8 N respectively). The sample without pre-coat (V) had a tuftbind strength of 9±2 N.

Conclusions

These results suggests that it is more efficient to apply the pre-coat in one layer and that an extra drying step will not improve the tuftbind strength/filament binding.

Example 15

Purpose

The purpose of this test is to get an indication of how carpet coated with water-based adhesive will perform in real life. The Taber test is done to check (or at least get an indication) of how the carpet performs after extended use. The focus of the test is on how well the face yarn holds up during use and whether or not the coating crumbles to powder. Since the polyester used as pre-coat in this example has a Tg above RT, the material inherently is brittle, which is a risk for pulverisation.

Methods

Pre-Coat of Polyester Tufted Primary Backing

The dispersion was mixed for 3 minutes by use of a kitchen mixing machine to create a foam.

The foamed dispersion was applied on the back side of the carpet by use of pre-coat machinery via a paint roller. The amount that was needed to pre-coat the carpet is calculated using the solids content of the dispersion.

The carpet was dried in the ventilated oven for 5 minutes at 150° C.

The samples were cooled down to room temperature.

Lamination of Pre-Coated Tufted Primary Backing (or Untreated Tufted Primary Backing)

Settings laminator: Speed 8 m/min, oil temperature 140° C., Gaps between the rollers depend on the amount of hotmelt adhesive needed (range 0.2-0.5 mm).

Applied amount of polyester hotmelt adhesive is around 200 g/m2 for the loop-pile tufted primary backing and around 170 g/m2 for the cut-pile tufted primary backing.

Materials

Loop-pile polyester tufted primary backing (see Example 7)

Cut-pile polyester tufted primary backing. (see Example 7)

Polyester dispersions from resins H (HLB of 8.1)

Latex A as reference (contains no polyester pre-coat layer, only the hotmelt adhesive and secondary backing)

Results and Conclusions

The results regarding the obtained tuftbind strength are provided in Table 12.

TABLE 12

Tuftbind strength after various durability tests

| Dispersion from | amount pre-coat (gm/2) | Carpet type | Taber test: weight loss (%) | Tuftbind strenght (N) for test | Tuftbind strenght (N) after test |
|---|---|---|---|---|---|
| REF | — | loop pile | 8 | x | x |
| Resin H | 128 | loop pile | 3 | x | x |
| Resin H | 182 | loop pile | 2 | x | x |
| REF | — | cut pile | 5 | 6.1 | 5.6 |

TABLE 12-continued

| Tuftbind strength after various durability tests | | | | | |
|---|---|---|---|---|---|
| Dispersion from | amount pre-coat (gm/2) | Carpet type | Taber test: weight loss (%) | Tuftbind strenght (N) for test | Tuftbind strenght (N) after test |
| Latex A | 110 | cut pile | 1 | 11.6 | 8.3 |
| Resin H | 200 | cut pile | 1 | 17.2 | 16.8 |

Based on the results obtained, the following could be concluded:

Loop-pile polyester carpet: weight loss of the reference 8%. For the two pre-coated samples this was 3% and 2% respectively (128 and 182 g/m2).

Cut-pile polyester carpet: weight loss sample of the reference is 5%, and the pre-coated samples have more or less comparable weight loss (1.2-1.3%).

The tuftbind strength of the sample before and after the Taber test was determined on the cut-pile samples only. Only a slight decrease in strength was observed.

The samples were analysed with a microscope after the Taber test was done. No indication of a pulverised pre-coat layer was observed.

Example 16

Purpose

The purpose of this test series was to study the effect on tuftbind strength and delamination using the same amount of pre-coat adhesive but different amounts of lamination adhesive.

Dimensional stability was assessed for carpet samples containing water-based pre-coat and laminating adhesive.

Materials

Polyester tufted primary backing (size 20×30 cm) (see Example 7).

Kitchen mixing machine (3 liter), type Bestron® AKM900SDM

Ventilated oven, Memmert UF1060

Paint roller (10 cm)

Weight balance

Water bath (20° C.)

Laminator: Lacom MBPL-600 Pilot—Laminator

Secondary backing: polyester material (supplier TWE), 350 g/m2

Polyester hotmelt adhesive (DSM)

Polyester dispersion from resin I (HLB of 8.0)

Methods

Pre-Coat of Polyester Tufted Primary Backing

The dispersion was mixed for 3 minutes by use of a kitchen mixing machine to create a foam.

The foamed dispersion was applied on the back side of the carpet by use of a paint roller. The amount that is needed to pre-coat the carpet was calculated using the solids content of the dispersion.

The carpet was dried in the ventilated oven for 6 minutes at 150° C.

The samples were cooled down to room temperature.

Lamination of Pre-Coated Tufted Primary Backing

Settings laminator: Speed 8 m/min, oil temperature 140° C., Gaps between the rollers depend on the amount of hotmelt adhesive needed (range 0.2-0.3 mm).

Applied amount of polyester hotmelt adhesive is around 128 g/m2 for sample 1 and 146 g/m2 for sample 2. Both samples have the same amount of pre-coat (75 g/m2) (see Table 13).

For the dimensional stability test the applied amount of polyester hotmelt adhesive is 180 g/m2. The amount of pre-coat is 50 or 100 g/m2 (see Table 14).

The assessment took place as follows:

For the dimensional stability test, the samples were placed flat and stress-free in both oven and water bath.

Step 1: Take initial value of tuft bind strength

Step 2: 2 hrs oven at 60° C.;

Step 3: 2 hrs water bath at 20° C.

Step 4: 24 hrs in oven at 60° C.

Step 5: 8 hrs at 20° C. (standard humidity)

Step 6: determine tuft bind strength and visual inspection

Results

The results are indicated here below in tables 13 and 14.

TABLE 13

| Delamination test | | | |
|---|---|---|---|
| Amount pre-coat (g/m2) | Amount hot melt (g/m2) | Tuftbind strenght (N) | Delamination strenght (N) |
| 75 | 128 | 19 | 42 |
| 75 | 146 | 25 | 55 |

TABLE 14

| Dimensional stability test | | |
|---|---|---|
| Amount pre-coat (g/m2) | Amount hot melt (g/m2) | Tuftbind strenght (N) |
| 50 | 180 | 19 |
| 100 | 180 | 32 |

Conclusions

Using a higher amount of water-based pre-coat results in a higher tuftbind strength The resistance against delamination depends on the amount of hotmelt adhesive.

Dimensional stability (visual inspection): no differences in appearance were observed

Example 17

Purpose

The purpose of this experiment was to assess the filament binding of three different carpet samples by a performance cleaning test.

Materials

Polyester tufted primary backing (size 50×30 cm): combined loop-pile and cut-pile (see Example 7).

Kitchen mixing machine (3 liter), type Bestron® AKM900SDM.

Ventilated oven, Memmert UF1060.

Paint roller (10 cm).

Weight balance.

Laminator: Lacom MBPL-600 Pilot—Laminator.

Secondary backing: polyester material (supplier TWE), 350 g/m2.

Polyester hotmelt adhesive (DSM 180 g/m$^2$).

Water-based pre-coat: Dispersion from resin I. Two different amounts of pre-coat were tested, 50 and 100 g/m$^2$.

QMC-007 carpet tester.

Assessment

The used test method was developed by the company James: "Quality Maintenance Control", abbreviated QMC-007 (see EP 2198263B1). With this unique testing machine the cleaning and maintenance possibilities of different materials, in particular different types of carpets, can be assessed.

The change in appearance of the carpet caused by the mechanical brushes is visually assessed using the standard EN 1471. The assessment scale is 1-5, where 1 means a strong and 5 means no difference compared to untreated carpet.

Results and Conclusion

The counter rotating brushes were able to pull out at least some filaments on all the samples.

The 50 g/m$^2$ quality showed most pulled filaments, the 100 g/m$^2$ quality showed almost none. After 30 rotating brush cycles the appearance of the 50 g/m$^2$ sample was assessed with a value of 3 and the 100 g/m$^2$ with a value of 4.5

After 60 rotating brush cycles the appearance of the 50 g/m$^2$ sample was assessed with a value of 2 and the 100 g/m$^2$ with a value of 4.

Example 18

Purpose

The aim of this experiment was to test two types of experimental polyester adhesives representing the (almost) outermost ranges of the adhesives for use in the present invention, viz:

Dispersion of resin K (HLB of 10.4)

Dispersion of resin I (HLB of 8.0)

The samples were both full polyester cut pile carpets (see Example 7). The polyester adhesives were applied as foamed dispersions at 100 g/m2 (100 g of polyester solids). After application of the foamed dispersion the samples were dried for 6 minutes in a ventilated oven at 150° C.

These samples were subjected to the water submerging test as described in example 3. The data are depicted in table 15 here beneath.

TABLE 15

Water sensitivity of the tuft bind

| Water test | Weight | Tuftbind before test | Tuftbind wet sample | Tuftbind after drying |
|---|---|---|---|---|
| Test at RT | | | | |
| pre-coat resin K | 10.64 g | 5.8 ± 2.0N | <1N | 3.7 ± 1.2N |
| pre-coat resin I | 10.80 g | 4.9 ± 1.4N | 4.3 ± 0.9N | 4.6 ± 1.2N |
| Test at 50° C. | | | | |
| pre-coat resin K | 10.55 g | 5.8 ± 2.0N | <1N | <1N |
| pre-coat resin I | 11.08 g | 4.9 ± 1.4N | 4.2 ± 0.9N | 4.9 ± 1.2N |

Both products have an acceptable water resistance at 20°. However, at a HLB value of 10.4, the resistance against loss of tuft bind due to exposure to water is less, in particular when the sample is still wet. Therefore, a lower HLB value is preferred when aiming at durability in the face of regular water treatment.

The invention claimed is:

1. A polyester textile product comprising:

a first polyester sheet, polyester yarns stitched through the first sheet forming a pile on a first surface of the first sheet, the pile extending from the first surface, and forming loops of the yarns at an opposing second surface of the first sheet, a polyester adhesive provided at the second surface of the first sheet to interconnect the loops and the first sheet, wherein the polyester adhesive is composed of a polyester material wherein the polyester material is a material the continuous phase of which is made out of an amorphous polyester which has a glass transition temperature above 20° C., for at least 90% (w/w) and wherein the polyester material has a hydrophilic-lipophilic balance value between 7.6 and 10.5 and a static contact angle with water above 75°.

2. The polyester textile product according to claim 1, wherein the polyester material has a hydrophilic-lipophilic balance value between 7.6 and 9.3.

3. The polyester textile product according to claim 1, wherein the polyester material is composed of the amorphous polyester.

4. A method to manufacture the polyester textile product of claim 1, the method comprising:

providing a first polyester sheet, stitching polyester yarns through the first sheet to form a pile on a first surface of the first sheet, the pile extending from the first surface, and to form loops of the yarns at an opposing second surface of the first sheet, applying a first quantity of an aqueous dispersion to the second surface of the first sheet, wherein the aqueous dispersion comprises an aqueous dispersion medium and polyester particles dispersed in the medium and having a number average particle size between 10 and below 1000 nm and which polyester particles are composed of a polyester material wherein the polyester material is a material the continuous phase of which is made out of an amorphous polyester which has a glass transition temperature above 20° C., for at least 90% (w/w), and wherein the polyester material has a hydrophilic-lipophilic balance value between 7.6 and 10.5 and a static contact angle with water above 75°, thereafter removing the aqueous dispersion medium from the said first quantity of the aqueous dispersion, heating the polyester particles to above a temperature at which the polyester of these particles softens, and subsequently cooling the polyester of the particles to below a temperature at which the polyester solidifies to therewith interconnect the loops and the first sheet with the solidified polyester.

5. The method according to claim 4, wherein the steps of removing the aqueous dispersion medium from the said first quantity of the aqueous dispersion and heating the polyester particles to above a temperature at which the polyester softens, take place concurrently by heating the first sheet in an oven.

6. The method according to claim 4, wherein the first quantity of a dispersion is applied such that the amount of polyester particles is between 50 and 250 g/m$^2$.

7. The method according to claim 4, wherein a second sheet is adhered to the second surface of the first sheet and wherein the second sheet is applied to the second surface of the first sheet after heating the polyester particles to above a temperature at which the polyesters softens, either before the subsequent cooling of the polyester, or by reheating the polyester particles subsequent to the said cooling.

8. The method according to claim 4, wherein a second sheet is adhered to the second surface of the first sheet and wherein after the cooling of the polyester, a second quantity of the dispersion is applied to the second surface of the first sheet, whereafter the aqueous dispersion medium is removed from the said second quantity of the aqueous dispersion, heating the polyester particles of the said second quantity of the aqueous dispersion to above a temperature at which the polyester of the particles softens, applying the second sheet, and subsequently cooling the polyester of the particles to below a temperature at which this polyester solidifies to therewith connect the second sheet.

9. The method according to claim 4, wherein a second sheet is adhered to the second surface of the first sheet and wherein after the cooling of the polyester, a layer of hot melt adhesive is applied to the second surface of the first sheet, whereafter the second sheet is applied to therewith connect the second sheet.

10. The method according to claim 4, wherein the polyester material is composed of the amorphous polyester.

11. The method according to claim 4, wherein the polyester material has a hydrophilic-lipophilic balance value is between 7.6 and 9.3.

12. The method according to claim 10, wherein the steps of removing the aqueous dispersion medium from the said first quantity of the aqueous dispersion and heating the polyester particles to above a temperature at which the polyester softens, take place concurrently by heating the first sheet in an oven.

13. The method according to claim 10, wherein the first quantity of a dispersion is applied such that the amount of polyester particles is between 50 and 250 $g/m^2$.

14. The method according to claim 10, wherein a second sheet is adhered to the second surface of the first sheet and wherein the second sheet is applied to the second surface of the first sheet after heating the polyester particles to above a temperature at which the polyesters softens, either before the subsequent cooling of the polyester, or by reheating the polyester particles subsequent to the said cooling.

15. The method according to claim 10, wherein a second sheet is adhered to the second surface of the first sheet and wherein after the cooling of the polyester, a second quantity of the dispersion is applied to the second surface of the first sheet, whereafter the aqueous dispersion medium is removed from the said second quantity of the aqueous dispersion, heating the polyester particles of the said second quantity of the aqueous dispersion to above a temperature at which the polyester of the particles softens, applying the second sheet, and subsequently cooling the polyester of the particles to below a temperature at which this polyester solidifies to therewith connect the second sheet.

16. The method according to claim 10, wherein a second sheet is adhered to the second surface of the first sheet and wherein after the cooling of the polyester, a layer of hot melt adhesive is applied to the second surface of the first sheet, whereafter the second sheet is applied to therewith connect the second sheet.

* * * * *